US009981279B2

(12) United States Patent
Edenilson

(10) Patent No.: US 9,981,279 B2
(45) Date of Patent: May 29, 2018

(54) DISPENSING DEVICE FOR DISPENSING A VISCOUS OR LIQUID PRODUCT FROM A RESERVOIR, AND A RECEPTACLE COMPRISING SUCH A DISPENSING DEVICE

(71) Applicant: ALBEA DO BRASIL EMBALAGENS LTDA, Jundiai Sao Paulo (BR)

(72) Inventor: Aldo Fadel Edenilson, Jundiai (BR)

(73) Assignee: Albea Do Brasil Embalagens LTDA, Jundiaí, Sao Paulo (BR)

( * ) Notice: Subject to any disclaimer, the term of this patent is extended or adjusted under 35 U.S.C. 154(b) by 0 days. days.

(21) Appl. No.: 15/190,680

(22) Filed: Jun. 23, 2016

(65) Prior Publication Data

US 2017/0001211 A1 Jan. 5, 2017

(30) Foreign Application Priority Data

Jul. 3, 2015 (EP) ..... 15175355

(51) Int. Cl.
*B05B 11/00* (2006.01)
*B65D 83/00* (2006.01)

(52) U.S. Cl.
CPC ..... *B05B 11/3059* (2013.01); *B05B 11/0027* (2013.01); *B65D 83/00* (2013.01); *B05B 11/3047* (2013.01); *B05B 15/656* (2018.02); *B65D 2255/20* (2013.01)

(58) Field of Classification Search
CPC ..... B05B 11/3059; B05B 11/0027; B05B 15/068; B05B 11/3047; B65D 83/00; B65D 2255/20
See application file for complete search history.

(56) References Cited

U.S. PATENT DOCUMENTS

2008/0023498 A1 1/2008 Bertin et al.
2008/0116232 A1 5/2008 Michaux et al.
2008/0135581 A1* 6/2008 Kennedy ..... B05B 11/3009 222/205
2012/0292344 A1 11/2012 Valois
2015/0335528 A1* 11/2015 Kim ..... A61H 35/04 128/200.17

FOREIGN PATENT DOCUMENTS

FR 2953497 A1 6/2011

OTHER PUBLICATIONS

Dec. 15, 2015—European Search Report—App. 15175355.5-1760.

* cited by examiner

*Primary Examiner* — Donnell Long
(74) *Attorney, Agent, or Firm* — Banner & Witcoff, Ltd.

(57) ABSTRACT

A dispensing device for dispensing a viscous or liquid product from a fluid reservoir, and having an actuator 1, a controlling member 2, a dispensing member 3, a collar 4 configured to be linked to the reservoir, and an extender 5. The dispensing device configured so that an actuation of the controlling member 2 causes a relative movement of the actuator 1 and the collar 4 thanks to which the dispensing device reversibly switches from a first configuration, in which the dispensing member 3 is unable to be activated, to a second configuration in which the actuator 1 is coupled in translation with the extender 5, so that when the actuator is pushed down 1 it activates the dispensing member 3.

11 Claims, 6 Drawing Sheets

DISPENSING DEVICE FOR DISPENSING A VISCOUS OR LIQUID PRODUCT FROM A RESERVOIR, AND A RECEPTACLE COMPRISING SUCH A DISPENSING DEVICE

CROSS-REFERENCE TO RELATED APPLICATIONS

The present application claims priority to European Patent Application No. 15175355.5 filed Jul. 3, 2015. The present application claims priority to and the benefit of all the above-identified application, which is incorporated by reference herein in its entirety.

FIELD

The present invention relates to a dispensing device for dispensing a viscous or liquid product from a reservoir.

BACKGROUND

In the prior art, dispensing devices are provided with an actuator and a pump mechanism, the actuator being directly coupled with the pump mechanism. To avoid an involuntary actuation of the pump mechanism, dispensing devices are also known to be provided with a mechanism which allows two different configurations: a first configuration in which the actuation of the actuator is blocked and a second configuration in which the pump mechanism can be activated by pressing the actuator.

However, there is still a need for improvement in this area.

SUMMARY

To meet this aim, aspects of the present invention provide a dispensing device for dispensing a viscous or liquid product from a fluid reservoir, said dispensing device comprising an actuator, a controlling member, a dispensing member, a collar, configured to be linked to the reservoir, and an extender, said dispensing device being configured so that an actuation of the controlling member causes a relative movement of the actuator and the collar thanks to which the dispensing device reversibly switches from a first configuration, in which the dispensing member is unable to be activated, to a second configuration in which the actuator is coupled in translation with the extender, so that when the actuator is pushed down it activates the dispensing member.

According to different embodiments, which can be taken together or separately:

- the extender is coupled with the dispensing member,
- the extender is guided in translation on the collar,
- the actuator is guided in translation on and engaged on rotation with the controlling member,
- the controlling member is guided in rotation on the collar,
- the actuator is guided both in translation and in rotation on the collar,
- an actuation of the controlling member causes a relative rotation of the actuator and the extender,
- the actuator is decoupled from the extender when the dispensing device is switched from one configuration to the other,
- one of the collar and the actuator comprises a lug and the other one of the collar and the actuator comprises a guiding track, said lug being designed to engage with said guiding track,
- the actuator comprises at least one orifice for dispensing said product,

- said orifice enabling a dispensing of the product in a direction parallel to a pushing direction of the actuator,
- the actuator comprises a thrust surface,
- the at least one orifice being arranged on said thrust surface of the actuator,
- the collar is configured to be reversibly fastened to the reservoir,
- the collar is configured to be disconnected from the reservoir by an actuation of the controlling member,
- said controlling member and said collar are configured so that a rotation of the controlling member relative to the collar causes a disconnection of the dispensing device from the reservoir,
- the dispensing member downwardly abuts on said collar,
- the actuator downwardly abuts against the extender when the dispensing device is set to the second configuration.

Aspects of the invention also provides a receptacle comprising a reservoir and a dispensing device as described above.

BRIEF DESCRIPTION OF THE DRAWINGS

The invention is more fully described below with reference to the accompanying drawings which show an embodiment of the invention by way of non limiting example.

DETAILED DESCRIPTION OF EXEMPLARY EMBODIMENTS

Figure 1:
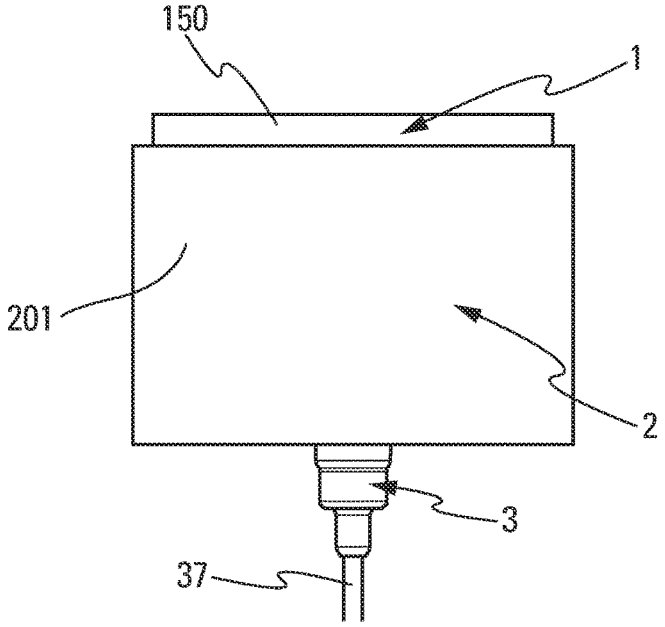
FIG. 1 is a front view of such embodiment, in a first configuration.
Figure 2:
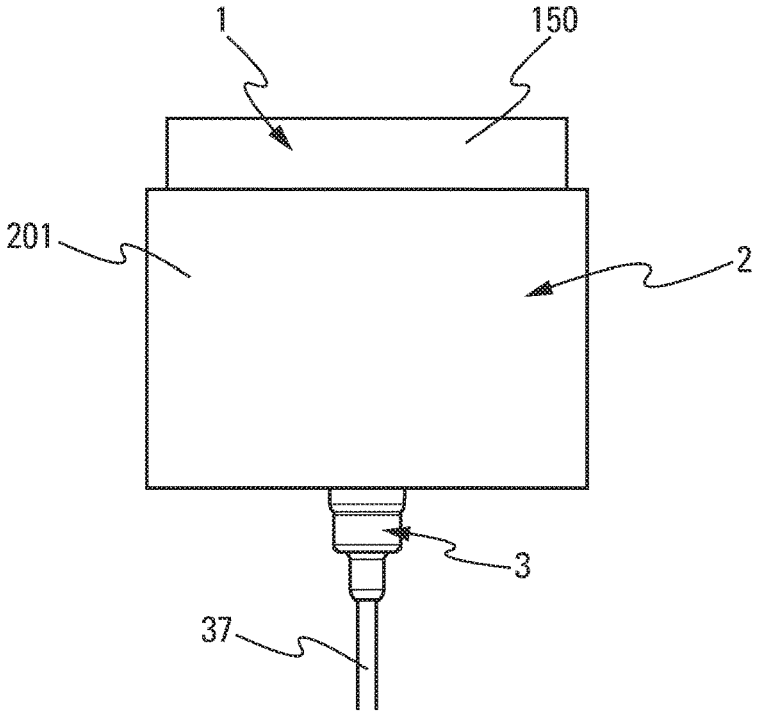
FIG. 2 is a front view of the dispensing device shown in FIG. 1, in a second configuration.

In the following description, the terms for spatial positioning are taken with reference to the position of the dispensing device as shown in the above-mentioned FIGS. 1 to 4.

Aspects of the invention relates to a dispensing device for dispensing a viscous or liquid fluid stocked in a fluid reservoir. Said reservoir, not shown, may comprise a neck and a body. The body of the reservoir can be cylindrical or polygonal and is designed to stock the fluid. Advantageously, the dispensing device is designed to be reversibly connectable to the neck of said reservoir. The dispensing device can be fastened, for example by screwing, on the neck of said reservoir. In this case, a surface of the neck can be threaded.

Referring to FIGS. 1 to 6, according to aspects of the invention, the dispensing device comprises an actuator 1, a controlling member 2, a dispensing member 3, a collar 4 and an extender 5.

The dispensing member 3 can be a pump mechanism or a valve mechanism. Here, the dispensing member 3 is a pump mechanism. Said pump mechanism 3 advantageously comprises an actuator rod 36, a pump body and a feed tube 37. The extender 5 and the activator rod 36 are coupled in axial translation, meaning that they move simultaneously in translation, which causes an actuation of the pump mechanism 3 and a distribution of product.

Figure 3:
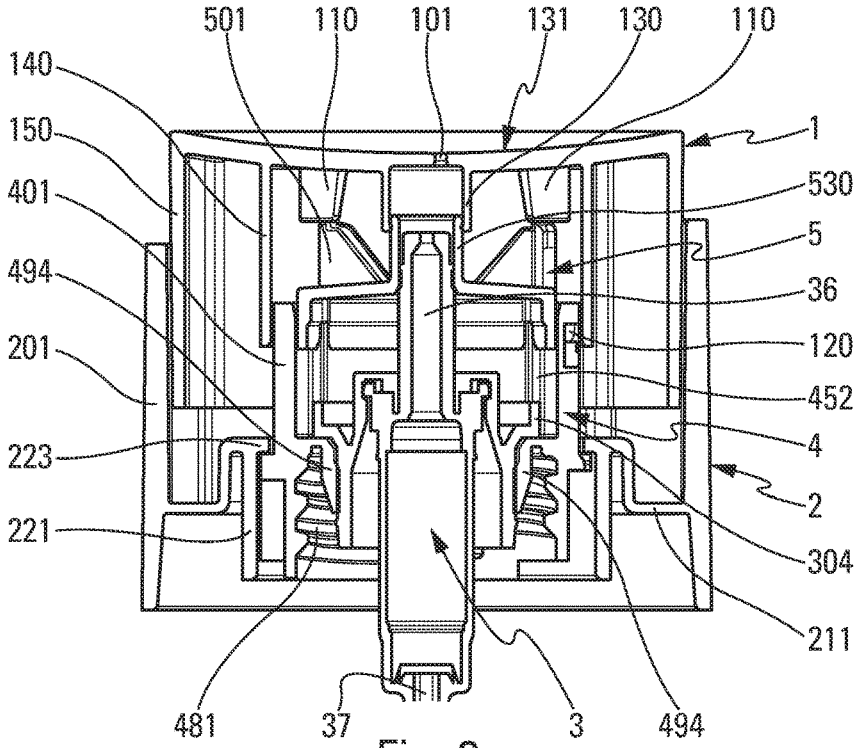
FIG. 3 is a cross sectional view of the dispensing device shown in FIG. 2 along its longitudinal axis, in the second configuration.
Figure 4:
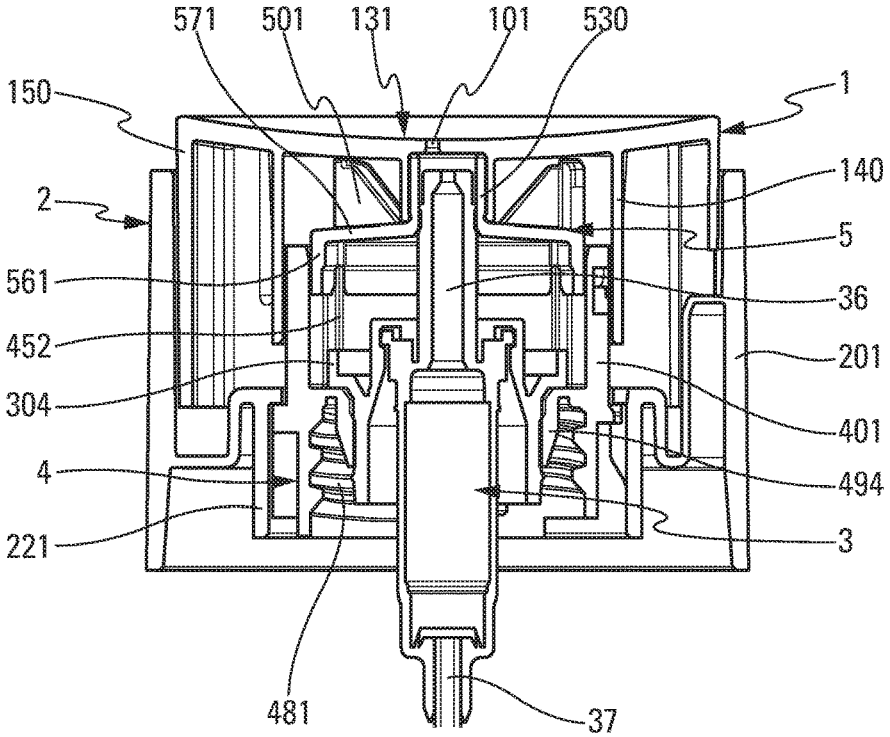
FIG. 4 is a cross sectional view of the dispensing device shown in FIG. 1 along its longitudinal axis, in the first configuration.
Figure 5:
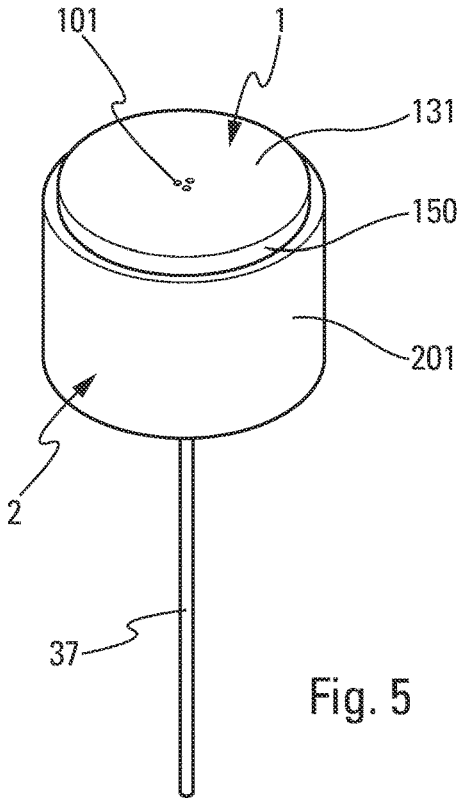
FIG. 5 is a perspective view of the dispensing device as shown in FIG. 1.
Figure 6:
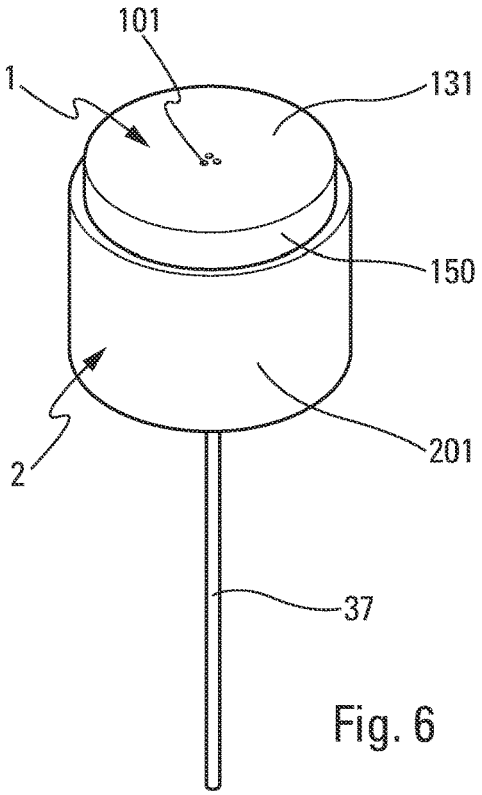
FIG. 6 is a perspective view of the dispensing device as shown in FIG. 2.
Figure 7:
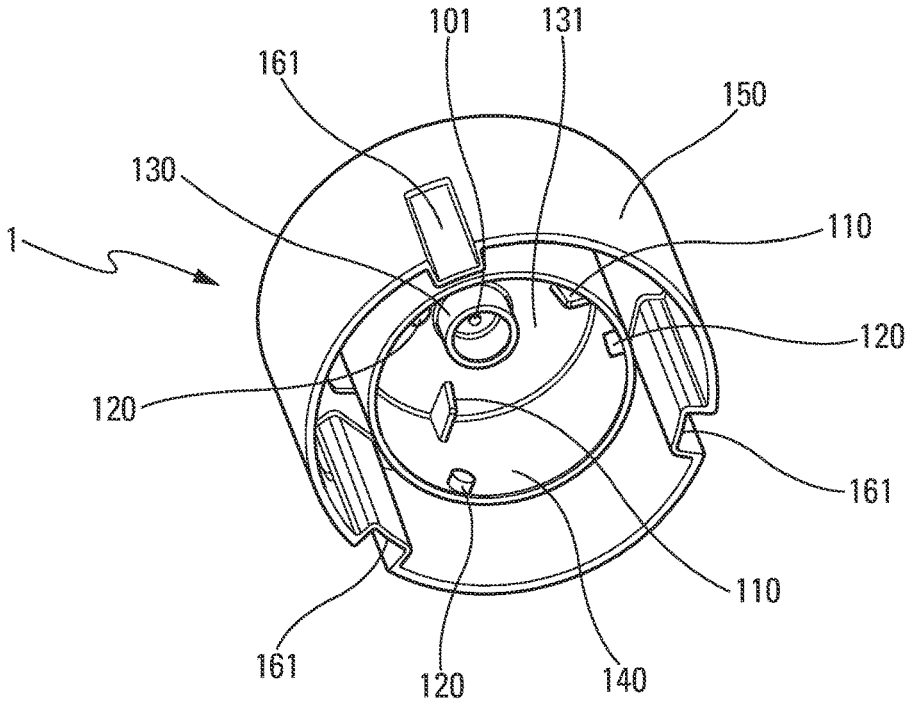
FIG. 7 is a perspective view of the actuator according to an aspect of the present invention.

Referring to FIGS. 3, 4 and 7, the actuator 1 has a cylindrical general shape and substantially extends along an axial direction. The actuator 1 comprises a thrust surface 131 which can be pressed by a user in a pushing direction, said pushing direction being parallel to the axial direction. Said thrust surface 131 has an upper side that is designed to face an outside of the dispensing device and a lower side that is designed to face an inside of the dispensing device. The actuator 3 further comprises an outer sleeve 150 and an inner sleeve 140. The inner sleeve 140 and the outer sleeve 150 concentrically extend along the axial direction, from the lower side of the thrust surface 131. The inner sleeve 140 and the outer sleeve 150 both substantially extend orthogonally from the lower side of the thrust surface 131. The outer sleeve 150 extends from an external periphery of the thrust surface 131. Said thrust surface 131 is slightly incurved for reasons of ergonomics but could also be planar or convex.

Advantageously, the outer sleeve 150 of the actuator 1 comprises one or several, here three, grooves or recesses 161. These recesses 161 radially recess toward an inside of the actuator 1. The radial direction is here defined orthogonal to the axial direction. Here, the recesses 161 have a rectangular transversal section, said transversal section being orthogonal to the axial direction. These recesses 161 are longitudinal and extend along the direction of extension of the outer sleeve 150, that is to say in the axial direction. In other words, each one of these longitudinal recesses 161 extends axially along the outer sleeve 150. The recesses 161 extend from a free end of the outer sleeve 150 of the actuator 1. They are evenly distributed along the periphery of the outer sleeve 150. It should be noted that the recesses 161 of the outer sleeve 150 do not extend up to the thrust surface 131. Advantageously, when the dispensing device is fully assembled, the recesses 161 cannot be seen by the user.

As will be hereinafter described, the recesses 161 are designed to engage with the controlling member 2, allowing the actuator 1 to axially slide into the controlling member 2.

The inner sleeve 140 of the actuator 1 is joined to the outer sleeve by the thrust surface 131. The inner sleeve 140 has an inner surface and an outer surface, the outer surface being parallel to and facing the outer sleeve 150. Here, the inner sleeve 140 comprises one or several, here three, lugs 120 on its inner surface. These lugs 120 are evenly distributed along the periphery of the inner surface of the inner sleeve 140. Said lugs 120 are substantially cylindrical and extend inwardly and radially from the inner surface of the inner sleeve 140. As will hereinafter be described, they are designed to engage with the collar 5.

The actuator 1 further comprises one or several, here three, tabs 110 also arranged on the inner surface of the inner sleeve 140. Here, these tabs 110 are located at a junction between the thrust surface 131 and the inner surface of the inner sleeve 140. Said tabs 110 extend radially and inwardly from the inner surface of the inner sleeve 140 and axially from the lower side of the thrust surface 131. Here, these tabs 110 are slightly rectangular but they could have a different general shape.

As will hereinafter be described, said tabs 110 are arranged and designed to transmit a force, exerted by the user in the pushing direction on the upper side of the thrust surface 131, to the extender 5.

One or several, here three orifices 101 are arranged through a center of the thrust surface 131. Advantageously, these orifices 101 extend from the lower side of the thrust surface 131 to its upper side. They allow a fluid communication from the inside of the dispensing device to the outside of it. The orifices 101 substantially axially extend through the thrust surface 131.

Moreover, the actuator 1 comprises an exit channel 130 which axially and downwardly extends from the lower side of the thrust surface 131. Here, the exit channel 130 substantially extends concentrically with the inner sleeve 140 and the outer sleeve 150 of the actuator 1. This exit channel 130 is located at the center of the thrust surface 131 and surrounds the orifices 101 of the thrust surface 131. As will hereinafter be described, the exit channel 130 is configured to engage with the extender 5.

Figure 8:
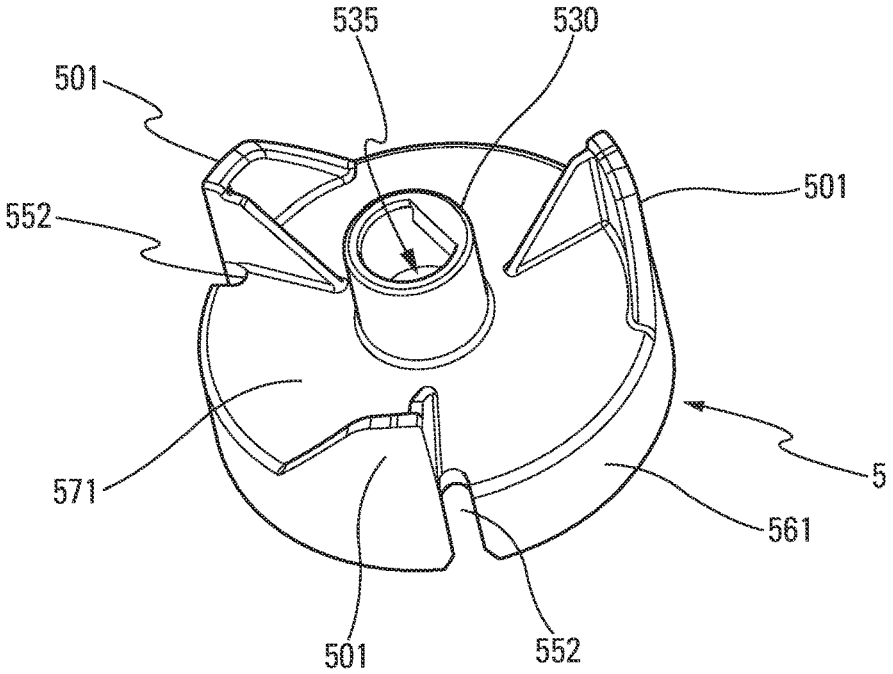
FIG. 8 is a perspective view of the extender according to an aspect of the present invention.
Figure 9:
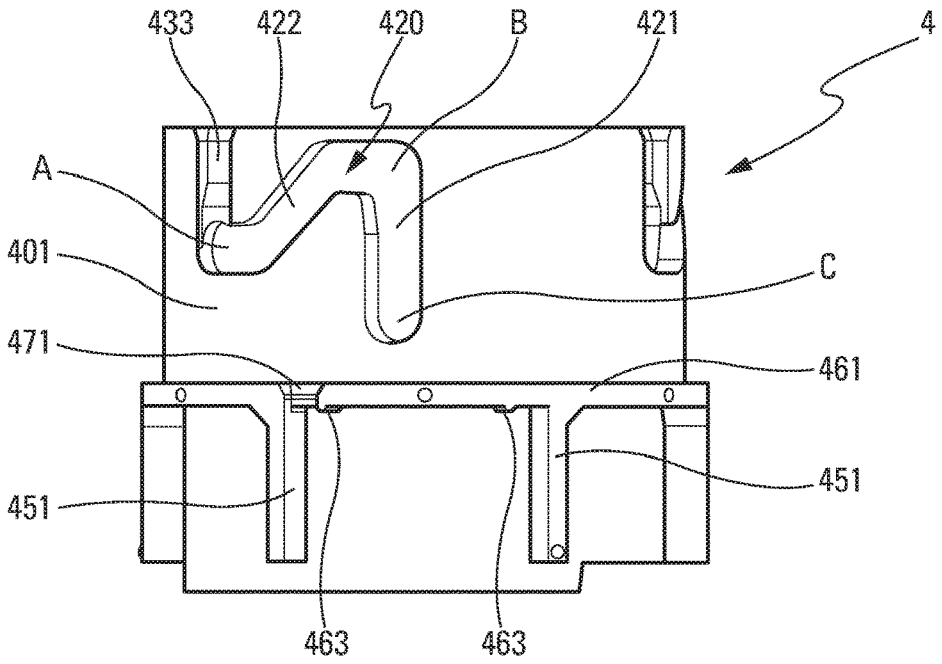
FIG. 9 is a perspective view a front view of the collar according to an aspect of the present invention.
Figure 10:
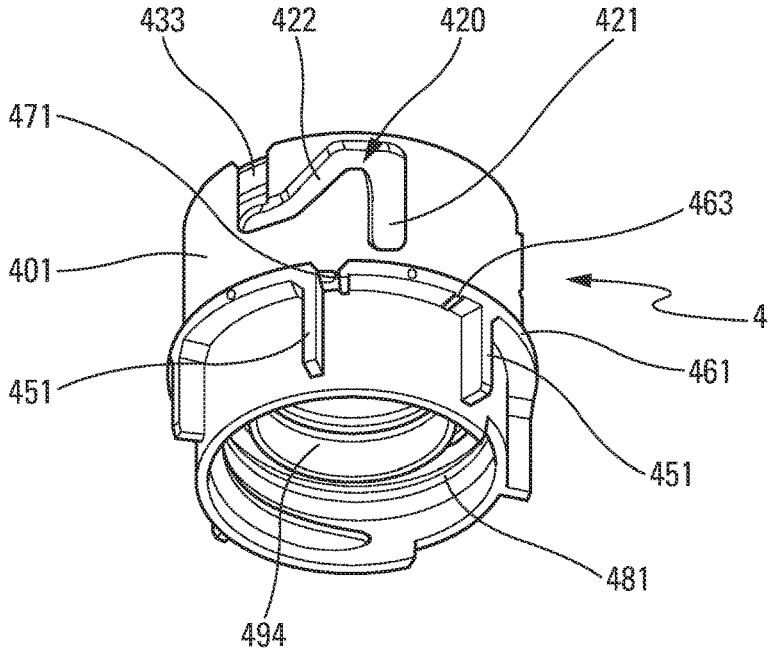
FIG. 10 is a perspective view of the collar shown in FIG. 9.

As illustrated at FIGS. 3, 4 and 8, the extender 5 comprises a circular plate 571 which defines an upper side, configured to face the thrust surface 131 of the actuator 1, and a lower side. An axial direction of the extender 5, orthogonal to the circular plate 571, can be defined. The extender 5 comprises an outer sleeve 561 that orthogonally and downwardly extends from the circular plate 571. Here the outer sleeve 561 extends from an external circular periphery of said circular plate 571. The outer sleeve 561 is provided with one or more, here three, axial notches 552 that axially extend from a free end of the outer sleeve 561 up to the circular plate 571. These notches 552 are advantageously evenly distributed along the periphery of the outer sleeve 561. As will hereinafter be described, the axial notches 552 are designed to engage with the collar 4 so as to block any rotation of the extender 5 relative to the collar 4.

The extender 5 further comprises one or more, here three, rib structures 501 that are designed on and extend from the upper side of the circular plate 571. The rib structures 501 extend orthogonally and upwardly from the circular plate 571. In other words, the rib structures 501 extend from the upper side of the circular plate 571.

Each one of these rib structures 501 is designed to respectively cooperate with one of the tabs 110 of the actuator 1 so as to transmit the force exerted by the user in the pushing direction from the actuator 1 to the actuator rod 36 of the pump mechanism 3, in one configuration of the dispensing device.

The extender 5 further comprises a central opening 535 which is located at a center of the circular plate 571. This central opening 535 allows a fluid communication between the reservoir and the exit channel 130 of the actuator 1. It extends from the upper side to the lower side of the circular plate 571. In other words, the central opening 535 passes axially through the center of the circular plate 571. The extender 5 also comprises a communication tube 530. This communication tube 530 orthogonally extends from the upper side of the circular plate 571 of the extender 5, at a periphery of the central opening 535. In other words, the communication tube 530 extends upwardly from the periphery of the central opening 535. An outer diameter of the communication tube 530 is substantially identical to an inner diameter of the exit channel 130 of the actuator 1 so that the communication tube 530 can engage with and slide in the exit channel 130.

Figure 11:
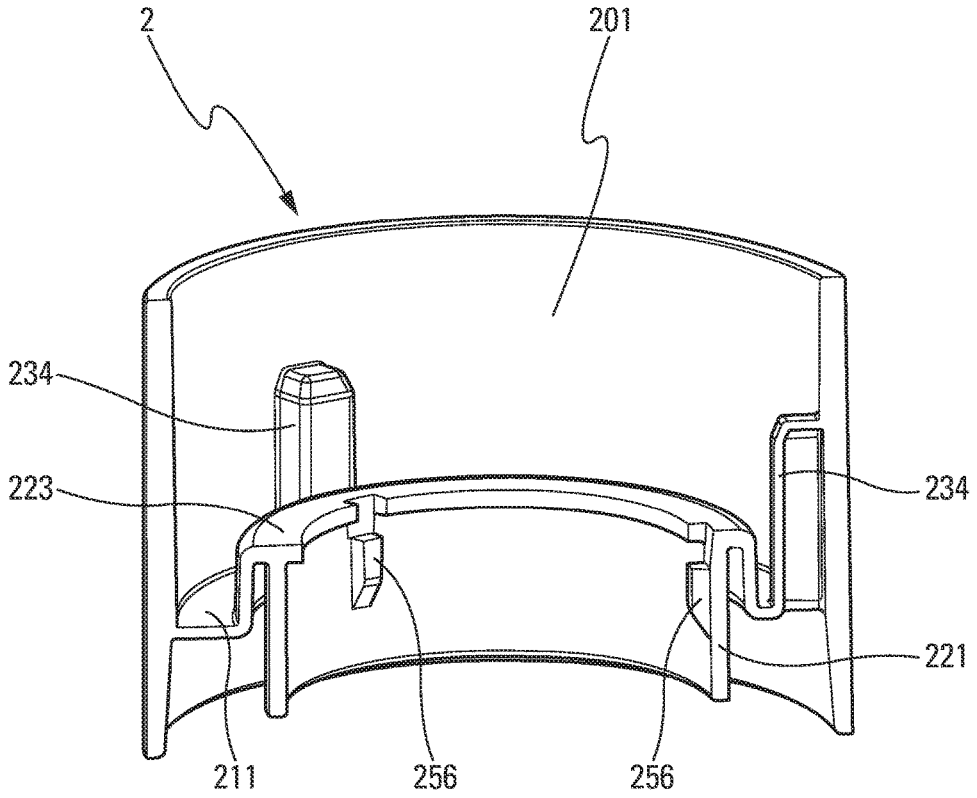
FIG. 11 is a perspective view of the controlling member cut-off in half along its longitudinal axis.

Advantageously, as illustrated in the FIGS. 3, 4 and 11, the controlling member 2 comprises a cylindrical outer casing 201 having an inner surface, an outer surface and an axial direction of extension. Said inner surface is provided with longitudinal sticks 234, here three, longitudinal sticks 234. These sticks 234 axially extend along the axial direction of the outer casing 201, in parallel with each other. Each of them is configured to respectively engage with one of the longitudinal recesses 161 of the actuator 1 which are configured to slide thereon. In other words, they are configured to act as tenons for the recesses 161 of the actuator 1. These sticks 234 are evenly and angularly distributed on the inner surface of the outer casing 201. The three sticks 234 are designed and configured so as to allow an axial translation of the actuator 1 relative to the controlling member 2. Simultaneously, they are designed to prevent any rotation of the actuator 1 relative to the controlling member 2. It should be noted that, when the dispensing device is fully assembled, the actuator 1 and the controlling member 2 are designed to have their respective axial direction merged with each other.

The outer casing 201 of the controlling member 2 is designed to be grasped by the user. It can be rotated around the axial direction relative to the collar as well as relative to the reservoir when the collar is fastened to the reservoir.

The controlling member 2 further comprises a peripheral ring 211 and an inner sleeve 221. The peripheral ring 211 advantageously radially and inwardly extends from an inner surface of the outer casing 201, said radial direction being orthogonal to the axial direction of the controlling member 2. Said peripheral ring 211 here comprises a central opening from a periphery of which axially extends the inner sleeve 221 of the controlling member 2. In other words, the inner sleeve 221 and the outer casing 201 of the controlling member are joined to each other by the peripheral ring 211. In other words, the peripheral ring 211 acts as a radial junction between the outer casing 201 and the inner sleeve 221. Advantageously, the longitudinal sticks 234 of the controlling member 1 axially extend on the inner surface of the outer casing 201 from an upper side the peripheral ring 211. In other words, the sticks 234 orthogonally extend from the peripheral ring 211 in an upward direction. It should be noted that the upper side of the peripheral ring 211 is here arranged to face the lower side of the thrust surface 131 of the actuator 1.

The controlling member 2 is designed to axially engage with the collar 4. An inner surface of the inner sleeve of the controlling member 2 is provided with one or several, here three, axial ribs 256 and a peripheral rim 223. The peripheral rim 223 and the axial ribs 256 are designed to act as a snap-fastener system, said system being arranged to fasten the controlling member 2 to the collar 4 as will hereinafter be described. This snap-fastener system is configured to engage with the collar and block any axial translation of the controlling member 2 and the collar 3 relative to each other while a rotation of the controlling member is allowed.

As illustrated at the FIGS. 2, 4, 9 and 10, the collar 4 comprises a body 401 with a cylindrical general shape, said body 401 extending around an axial direction. Advantageously, the collar 4 is provided with one or more, here three, guiding tracks 420. Here, these guiding tracks are grooves 420. These grooves 420 are evenly distributed around the body 401 of the collar 4. Here, each groove 420 defines a helical part 422 and a vertical part 421, the helical part 422 and the vertical part 421 being connected to each other and sharing a common climax point at the intersection of the two parts 421 and 422. Advantageously, these grooves 420 have a width, measured orthogonally to a longitudinal direction of extension of each part of the groove 420, which substantially equals a diameter of the lugs 120 of the actuator 1. Indeed, these lugs 120 are configured to respectively engage with each one of the grooves 420. These grooves 420 define sinuous guiding tracks for the lugs 120, said lugs 120 being then able to be moved and guided inside said guiding tracks 420.

In other words, each groove 420 extends helically and upwardly from a first position A to a second position B from which the groove 420 extends axially and downwardly to a third point C. The part of the groove 420 between point A and point B corresponds with the helical part 422 of the groove 420 whereas the part of the groove between point B and point C corresponds with the vertical part 421 of the groove 420.

It should be noted that each lug 120 can therefore be moved from one part of its corresponding groove 420 to the other while staying engaged in the groove 420. In other words, there is no separation or boundary between the helical part 422 and the vertical part 421 of each groove 420.

Thanks to this layout, when one of the lugs 120 of the actuator 1 moves inside the helical part 422 of its corresponding groove 420, the actuator 1 is both axially and angularly displaced relative to the collar 4. In contrast, when the lugs 120 move inside the vertical part 421 of the grooves 420, the actuator 1 is only axially displaced relative to the collar 4.

Else, the collar 4 is provided on the external surface of its body 401 with a peripheral external rim 461. The thickness of the external rim, said thickness being measured in parallel to the axial direction of the body 401, here substantially equals an axial distance between the axial ribs 256 and the internal rim 223 of the controlling member 2. This external rim 461 of the collar 4 is designed to engage with the controlling member 2, between the axial ribs 256 and the internal rim 223 thereof.

To ease an assembly of the controlling member 2 on the collar 4, the external rim 461 of the collar 4 is provided with one or more, here three, discontinuities or recesses 471, which act as entrances in that they allow each one of the axial ribs 256 of the controlling member 2 to pass through and below the external rim 461. Once the collar 4 and the controlling member 2 are assembled together, they are coupled to each other in translation.

Also, in order to ease an assembly of the actuator 1 on the collar 4, the body 401 of the collar 4 is provided with one or more axial recesses 433, here three axial recesses 433, which are configured to ease the entrance of each of the lugs 120 into its corresponding groove 420. Specifically, each one of said recesses 433 axially extends from point A of each groove 420 to the top of the body 401.

The collar 4 also comprises on the outer surface of the body 401 one or more, here six, axial boundary ribs 451. Here, these boundary ribs 451 extend downwardly from the peripheral external rim 461 of the collar 2. The ribs 451 are evenly distributed at the periphery of said body 401. These ribs 451 are designed and configured to stand as rotational abutments for the controlling member 2. In other words, the ribs 451 are designed to limit the rotation of the controlling member 2 relative to the collar 4, said rotation being here limited to one sixth of a tour. Specifically, when the collar 2 and the controlling member 2 are mounted together thanks to the snap-fastener system, each one of the ribs 256 of the controlling member 2 can only rotate around the collar body 401 in its corresponding angular sector, said angular sector being defined by the angular distance between two successive axial boundary ribs 451 of the collar 4.

In other words, each one of the ribs 256 of the controlling member 2 can rotate between two successive ribs 451 of the collar 4.

On an inferior part of its inner surface, the collar 4 is provided with a thread so that the collar 4 can be reversibly connected to an external surface of the neck of the reservoir.

Furthermore, the collar 4 is provided with tiny spurs 463 that are arranged under the external rim 461 and project downwardly from it. Each of those tiny spurs 463 has a longitudinal direction of extension parallel to a radial direction of the body 401. These spurs 463 are designed to offer a resistance to a rotation of the controlling member 2 relative to the collar 4 and/or even emit a click sound when the controlling member 2 reaches or leaves one of the two angular abutment positions defined by the corresponding boundary rib 451. The double function of these spurs 463 is, first, to prevent an involuntary change of configuration of the dispensing device and, second, to warn the user when the controlling member 2 leaves or reaches one of the abutment positions.

Else, as illustrated on FIGS. 3 and 4, the collar 4 is provided on the inner surface of its body 401 with axial ribs 452 that extend in parallel to the axial direction of the body 401 and are designed to cooperate with the notches 552 of the sleeve 561 of the extender 5. The extender 5 and the collar 4 are therefore coupled in rotation while axial translation is allowed between these two components.

According to aspects of the invention, the dispensing device can be switched from a first configuration to a second configuration. The first configuration corresponds to the configuration of the dispensing device when each one of the lugs 120 of the actuator 1 is located at the point A of its corresponding groove 420 of the collar 4. The second configuration of the dispensing device corresponds to the configuration where each one of the lugs 120 of the actuator 1 is located at the point B of its corresponding groove 420.

In reference to FIGS. 3 and 4, it should be noted that the extender 5 and the dispensing member 3 are configured to be mounted inside the collar 4. On the contrary, the actuator 1 and the controlling member 2 are configured to be mounted on the outside of the collar 4.

The controlling member 2 is configured to downwardly abut on the collar 4. Specifically, here, the peripheral rim 223 of the controlling member 2 is configured to downwardly abut against the peripheral external rim 461 of the collar 4.

Also, the pump mechanism 3 is configured to downwardly abut against the collar 4. Specifically, here, the pump mechanism 3 further comprises a shoulder 304 which downwardly abuts against an internal sleeve 494 of the collar 4.

We will now describe the mechanical interaction of the components described above with each other. We consider here the assembled dispensing device, the lugs 120 being at the point A. This corresponds to the first configuration of the dispensing device. This configuration corresponds to a retracted position of the actuator 1 inside the controlling member 2 (Cf. FIG. 1). In this configuration, an extreme upper part of the actuator 1 protrudes from the controlling member 2, and is still visible by the user. However, the actuator 1 cannot be pushed downward by the user because the actuator 1 is in an axial abutment position. Indeed, each lug 120 of the actuator 1 is limited in axial translation by its corresponding groove 420. Moreover, each one of the tabs 110 of the actuator 1 may be in contact and abut against the circular plate 571 of the extender 5. Therefore, the actuator 1 can only be moved up and this can only happen by a rotation of the controlling member 2 relative to the collar 4. Here, regarding the controlling member 2, this element cannot be rotated clockwise (or to the left) because each one of the axial internal ribs 256 of the controlling member 2 abuts against one of the external ribs 451 of the collar 4. In this first configuration, the activator rod 36 is in a rest position and the pump mechanism 3 is not dispensing fluid.

To be able to use the dispensing device, the user has to rotate the controlling member 2 counter clockwise (or to the right) relative to the collar 4. This manipulation allows the dispensing device to be switched from the first configuration to the second configuration.

Here, because the collar 4 is fastened to the neck of the fluid reservoir, a rotation of the controlling member 2 relative to the reservoir corresponds to an equivalent rotation of the controlling member 2 relative to the collar 4. The actuator 1 being coupled in rotation to the controlling member 2, a rotation of the controlling member 2 causes a rotation of the actuator 4. Specifically, when the controlling member 2 rotates counter clockwise (or to the right), each lug 120 of the actuator 1 moves inside its corresponding groove 420, along the helical part 421 thereof. At the same time, each one of the tabs 110 of the actuator 1 slides along an oblique part of the rib structures 501 of the extender 5. As a result, the actuator 1 axially moves up relative to the controlling member 2. While doing so, the movement of the actuator 1 relative to the collar 4 is a combination of a rotation and of an axial translation. The controlling member 2 can be rotated counter clockwise (or to the right) until it reaches the angular abutment position where each one of the internal ribs 256 of the controlling member abuts against another one of the six external ribs 451 of the collar 4.

During the above described rotation of the controlling member 2 relative to the collar 4, that is to say when the dispensing device is switched from one configuration to the other, the actuator 1 is decoupled from the extender 5 and from the activator rod 36.

When the controlling member 2 has just been rotated to the right and has reached one of the abutment positions, each one of the lugs 120 of the actuator is located at the point B of its corresponding guiding track 420. This situation corresponds to the second configuration of the dispensing device. In this configuration, the dispensing member 3 can be activated by a pushing of the actuator 1 by the user. In this configuration, each one of the tabs 110 of the actuator 1 is in contact with and abuts on an upper end of its corresponding rib structure 501 without any interaction of an intermediate component. Here, the actuator 1 cannot be lifted up because each one of the lugs 120 would abut against a superior edge of its corresponding guiding tracks 420. In this case, the user has a choice between rotating the controlling member 2 clockwise (or to the left) to get back to the first configuration or pushing the actuator 1 down to activate the pump mechanism 3. Specifically, if the user presses the thrust surface 131 of the actuator 1, the thrust surface 1 drives the tab 110 which then drives the extender 5 which drives the activator rod 36 of the pump mechanism 3.

In other words, an actuation of the actuator 1 causes the activator rod 36 to be moved down which activates the pump mechanism 3 and allow a dispensing of the fluid through the orifices 101 of the actuator 1. Simultaneously, the lugs 120 of the actuator are moved down along the vertical part 421 of the guiding tracks 420.

During the axial translation of the actuator 1, when the extender 5 is coupled in translation with the actuator 1, the notches 552 of the extender 5 are designed to slide against the internal ribs 452 of the collar 1.

As already said, advantageously, the collar 4 can be disconnected from the reservoir by an actuation of the controlling member 2. Specifically, once the controlling member 2 has reached one of the rotational abutment positions, if the user then forces the rotation of the controlling member 2 relative to the reservoir toward said abutment position, it leads to either a tightening or a loosening of the connection between the reservoir and the collar 4.

It should be noted that advantageously the pump mechanism 3 can be fastened to the collar 4.

It should also be noted that the dispensing device is configured so that the whole assembly of its components can be done by simple axial translations.

Moreover, advantageously, the dispensing device is configured so that a disconnection of the collar 4 from the reservoir causes a disconnection of the dispensing device as a whole from said reservoir.

The invention claimed is:

1. Dispensing device for dispensing a viscous or liquid product from a fluid reservoir, said dispensing device comprising an actuator, a controlling member, a dispensing member, a collar configured to be linked to the reservoir, and an extender, said dispensing device being configured so that an actuation of the controlling member causes a relative movement of the actuator and the collar thanks to which the dispensing device reversibly switches from a first configuration, in which the dispensing member is unable to be activated, to a second configuration in which the actuator is coupled in translation with the extender, so that when the actuator is pushed down it activates the dispensing member; and the collar is configured to be disconnected from the reservoir by an actuation of the controlling member.

2. Dispensing device according to claim 1, in which the extender is coupled with the dispensing member, the extender is guided in translation on the collar, the actuator is guided in translation on and engaged on rotation with the controlling member, the controlling member is guided in rotation on the collar and the actuator is guided both in translation and in rotation on the collar so that an actuation of the controlling member causes a relative rotation of the actuator and the extender.

3. Dispensing device according to claim 2, in which the actuator is decoupled from the extender when the dispensing device is switched from one configuration to the other.

4. Dispensing device according to claim 1, in which one of the collar and the actuator comprises a lug and the other one of the collar and the actuator comprises a guiding track, said lug being designed to engage with said guiding track.

5. Dispensing device according to claim 1, in which the actuator comprises at least one orifice for dispensing said product, said orifice enabling a dispensing of the product in a direction parallel to a pushing direction of the actuator.

6. Dispensing device according to claim 5, in which the actuator comprises a thrust surface, the at least one orifice being arranged on said thrust surface of the actuator.

7. The dispensing device according to claim 1, in which the collar is configured to be reversibly fastened to the reservoir.

8. Dispensing device according to claim 1, in which said controlling member and said collar are configured so that a rotation of the controlling member relative to the collar causes a disconnection of the dispensing device from the reservoir.

9. Dispensing device according to claim 1, in which the dispensing member downwardly abuts on said collar.

10. Dispensing device according to claim 1, in which the actuator downwardly abuts against the extender when the dispensing device is set to the second configuration.

11. Receptacle comprising a reservoir and a dispensing device according to claim 1.

* * * * *